US007811674B2

(12) United States Patent
Oohashi et al.

(10) Patent No.: US 7,811,674 B2
(45) Date of Patent: Oct. 12, 2010

(54) HOT-DIP GALVANIZING BATH AND GALVANIZED IRON ARTICLE

(75) Inventors: Kazuyoshi Oohashi, Takaoka (JP); Yoshiharu Kosaka, Takaoka (JP)

(73) Assignee: CK Metals Co., Ltd., Takaoka-Shi (JP)

( * ) Notice: Subject to any disclaimer, the term of this patent is extended or adjusted under 35 U.S.C. 154(b) by 0 days.

(21) Appl. No.: 11/973,191

(22) Filed: Oct. 5, 2007

(65) Prior Publication Data

US 2008/0072784 A1 Mar. 27, 2008

Related U.S. Application Data

(63) Continuation of application No. PCT/JP2007/051598, filed on Jan. 31, 2007.

(30) Foreign Application Priority Data

Feb. 2, 2006 (JP) ..... 2006-025316

(51) Int. Cl.
*B32B 15/18* (2006.01)
*C23C 30/00* (2006.01)

(52) U.S. Cl. ..... 428/659; 428/607; 428/615; 428/658; 428/682; 427/436; 148/533

(58) Field of Classification Search ..... 428/607, 428/615, 659, 682, 658
See application file for complete search history.

(56) References Cited

U.S. PATENT DOCUMENTS

| | | | | |
|---|---|---|---|---|
| 5,022,937 | A | 6/1991 | Tomita et al. | |
| 6,458,425 | B2 * | 10/2002 | Ferrero et al. | 427/433 |
| 6,517,955 | B1 * | 2/2003 | Takada et al. | 428/659 |
| 7,338,718 | B2 * | 3/2008 | Taira et al. | 428/633 |

FOREIGN PATENT DOCUMENTS

| | | | |
|---|---|---|---|
| EP | 0 269 006 | A2 | 6/1988 |
| JP | 56-105446 | * | 8/1981 |
| JP | 63-247331 | A1 | 10/1988 |
| JP | 63-247332 | A1 | 10/1988 |
| JP | 04-154950 | A1 | 5/1992 |
| JP | 2004-285387 | A1 | 10/2004 |

OTHER PUBLICATIONS

JP 04-154950 English Translation, May 1992.*
JP 2002-004018 English Machine Translation, Kazuhiko et al, Jan. 2002.*
JP 2000-119832 English Machine Translation, Yasuhide et al, Apr. 2000.*

* cited by examiner

*Primary Examiner*—Jennifer C McNeil
*Assistant Examiner*—Jason L Savage
(74) *Attorney, Agent, or Firm*—Burr & Brown

(57) ABSTRACT

A galvanized iron article is provided which is formed by hot-dipping the iron article in a galvanizing bath that contains 0.005 to 0.2 mass % of Cu and 0.001 to 0.1 mass % of Al, with the balance being Zn and unavoidable impurities, to provide a galvanized layer thereon.

5 Claims, 19 Drawing Sheets

FIG. 1

(%)

| SAMPLE No. | Pb | Cd | Cu | Al | Bi |
|---|---|---|---|---|---|
| 1 | 0. 001 | 0. 0003 | LESS THAN 0.001% | LESS THAN 0.001% | 0. 004 |
| 2 | 0. 001 | 0. 0003 | LESS THAN 0.001% | LESS THAN 0.001% | 2. 16 |
| 3 | 0. 001 | 0. 0003 | 0. 007 | 0. 062 | 1. 54 |
| 4 | 0. 002 | 0. 0003 | 0. 023 | 0. 007 | 1. 65 |
| 5 | 0. 001 | 0. 0003 | 0. 051 | 0. 005 | 0. 004 |
| 6 | 0. 002 | 0. 0004 | 0. 071 | 0. 003 | 1. 5 |

| AIR-COOLING TIME (S) | ELECTROLYTIC ZINC INGOT | CHANGE DUE TO ADDITION OF Al AND Cu | | | |
|---|---|---|---|---|---|
| | | Al 0.016% Cu 0.021% | Al 0.016% Cu 0.039% | Al 0.016% Cu 0.055% | Al 0.016% Cu 0.080% |
| 5 |  |  |  |  |  |
| 15 |  |  |  |  |  |

DISTRIBUTION OF Cu

DISTRIBUTION OF Al

HOT-DIP GALVANIZING BATH AND GALVANIZED IRON ARTICLE

CROSS REFERENCE TO RELATED APPLICATION

This application is a continuation of International Patent Application No. PCT/JP2007/051598, having an international filing date of Jan. 31, 2007, which designated the United States, the entirety of which is incorporated herein by reference. Japanese Patent Application No. 2006-025316 filed on Feb. 2, 2006 is also incorporated herein by reference in its entirety.

BACKGROUND OF THE INVENTION

The present invention relates to hot-dip galvanizing. More particularly, the invention relates to a galvanizing bath which produces a uniform alloy layer, and a galvanized iron article produced using the galvanizing bath.

Hot-dip galvanizing has been widely applied to iron and steel materials because an alloy layer of Zn and Fe contained in an iron article is formed to exhibit excellent adhesion, and excellent corrosion resistance is provided due to a sacrificial anode effect.

A galvanized coating includes an $FeZn_7$ (Fe: 7 to 11%) hexagonal $\delta_1$ alloy layer formed on the underlying iron, an $FeZn_{13}$ (Fe: about 6%) $\zeta$ (zeta) alloy layer formed on the $\delta_1$ alloy layer and having a columnar structure belonging to a monoclinic system, and an $\eta$ zinc layer formed on the $\zeta$ alloy layer and having a dense hexagonal structure.

The $\zeta$ alloy layer in such a galvanized coating structure is important for increasing the thickness of the galvanized coating. On the other hand, since the $\zeta$ alloy layer has a columnar structure, the $\zeta$ alloy layer has a low degree of symmetry as compared with other layers. If the thickness of the $\zeta$ alloy layer is nonuniform, corrosion resistance may decrease, or the galvanized coating may become fragile.

Moreover, since the $\zeta$ alloy layer is whitish as compared with the zinc layer, the appearance of the coating is impaired when the $\zeta$ alloy layer is partially formed near the surface of the galvanized coating.

JP-A-2004-285387 discloses technology of adding Al to a bath in an amount of 0.10 to 0.6% in order to improve the appearance of the galvanized coating. This technology aims at forming a Zn—Al—Fe ternary alloy layer.

JP-A-4-154950 discloses an Fe—Zn alloy galvanizing bath containing 0.1 to 10% of Fe.

JP-A-63-247331 discloses a colored hot-dip galvanizing zinc alloy containing 0.2 to 0.7% of Ti.

JP-A-63-247332 discloses an iridescent hot-dip galvanizing zinc alloy containing 0.1 to 0.8% of Mn.

SUMMARY OF THE INVENTION

Some aspects of the invention mainly aim at causing an alloy layer of a hot-dip galvanized coating to become uniform, and provide hot-dip galvanizing baths capable of producing a hot-dip galvanized coating exhibiting an excellent appearance and galvanized iron articles.

Hot-dip galvanizing baths according to some aspects of the invention comprise 0.005 to 0.2 mass % of Cu. The hot-dip galvanizing bath according to one aspect of the invention comprises 0.001 to 0.1 mass % of Al in addition to Cu, with the balance being Zn and unavoidable impurities. The hot-dip galvanizing bath according to another aspect of the invention further comprises 0.05 to 5.0 mass % of Bi in addition to Cu, Al, Zn, and the unavoidable impurities. The hot-dip galvanizing bath according to still another aspect of the invention further comprises 0.001 to 0.1 mass % of Sn in addition to Cu, Al, Zn, Bi, and the unavoidable impurities. The hot-dip galvanizing bath according to still another aspect of the invention further comprises 0.05 to 3.0 mass % of Pb in addition to Cu, Al, Zn, and the unavoidable impurities. The hot-dip galvanizing bath according to a further aspect of the invention further comprises 0.001 to 0.1 mass % of Sn in addition to Cu, Al, Zn, Pb, and the unavoidable impurities.

BRIEF DESCRIPTION OF THE DRAWINGS

FIG. 1 shows the composition of a galvanizing bath used to produce a corrosion resistance evaluation sample.

DETAILED DESCRIPTION OF THE INVENTION

Figure 2:
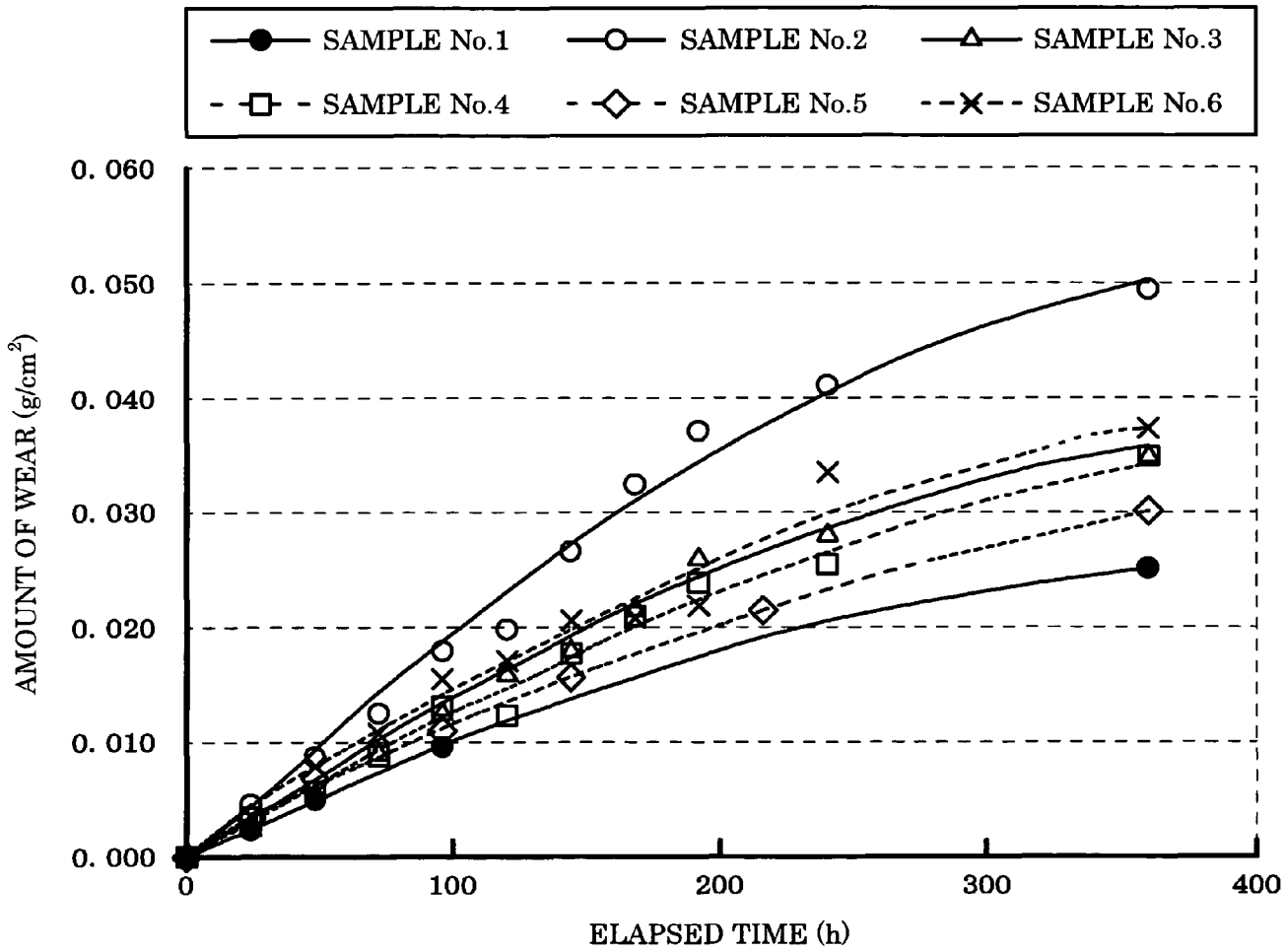
FIG. 2 shows measurement results of a reduction in weight of a galvanized coating subjected to a salt spray test.

An object of the invention is to provide a hot-dip galvanizing bath which provides excellent corrosion resistance and appearance, and a galvanized iron article.

The inventors of the invention have conducted extensive studies on the relationship between the composition of a hot-dip galvanizing bath and a ζ alloy layer to achieve the invention.

The inventors have melted an electrolytic zinc ingot (zinc ingot subjected to electrolytic refining) in a furnace, and gradually added an Al alloy to the zinc ingot. As a result, the inventors have found that formation of the ζ alloy layer is promoted when the Al content is 0.001 to 0.1 mass % ("mass %" is hereinafter simply indicated by "%"), and the ζ alloy layer changes from an $FeZn_{13}$ (Fe: about 6%) alloy layer into an Fe—Zn—Al ternary alloy layer when the Al content exceeds 0.1%.

When adding Al to the hot-dip galvanizing bath, Al forms a very thin aluminum oxide film on the surface of the η zinc layer to improve corrosion resistance. It was found that it is desirable to add Al to the galvanizing bath in an amount of 0.001 to 0.1%.

Although the addition of a small amount of Al allows the ζ alloy layer to be easily formed during immersion of an iron article in the galvanizing bath to increase the thickness of the galvanized coating, a reaction proceeds during air cooling until the galvanized article removed from the galvanizing bath is subjected to the next step, whereby the thickness of the columnar structure varies to a large extent. An uneven metallic gloss occurs if the columnar structure is partially formed near the surface of the galvanized coating, whereby the appearance tends to deteriorate.

A phenomenon in which the columnar structure varies to a large extent also occurs when using a Zn—Pb galvanizing bath containing 1 to 2% of Pb or a Zn—Bi galvanizing bath containing 0.1 to 3.0% of Bi instead of Pb from the environmental point of view (Pb free).

The inventors have conducted extensive studies on a component which eliminates the variation in the columnar structure of the ζ alloy layer. As a result, the inventors have found that the thickness of the ζ alloy layer can be made uniform and the following remarkable effects can be obtained by adding Cu in an amount of about 0.005 to 0.2%.

First, the surface gloss of the galvanized coating is improved by adding Cu to the hot-dip galvanizing bath.

Second, the ζ alloy layer formed when immersing the iron article in the hot-dip galvanizing bath can be suppressed within a specific range, and the growth of the ζ alloy layer can be suppressed when transferring the galvanized article removed from the galvanizing bath in the air (air cooling). As a result, the variation in the columnar structure formed of the ζ alloy layer can be suppressed to provide a ζ alloy layer with a uniform thickness, and dripping and retention of the galvanizing solution can be suppressed, whereby the appearance and the gloss can be made uniform.

Accordingly, a hot-dip galvanizing bath according to the invention comprises 0.005 to 0.2 mass % of Cu.

The upper limit of Cu is set at 0.2% because peeling easily occurs when the Cu content exceeds 0.2%. If the Cu content is less than 0.005%, the effect of addition of Cu is not obtained.

If the Cu content is increased, a suspended dross tends to adhere to the surface of the galvanized article when removing the galvanized article from the galvanizing bath. Therefore, the Cu content is preferably 0.005 to 0.08% from the viewpoint of the stability of the appearance. The Cu content is more preferably 0.01 to 0.08% from the viewpoint of easily suppressing the formation of the ζ alloy layer during air cooling.

In this case, the surface gloss of the galvanized coating is improved by adding Al in an amount of 0.001 to 0.1%. Moreover, a very thin alumina film is formed on the surface of the galvanized coating, whereby a primary rust prevention performance is improved.

When Al is added in an amount exceeding 0.1%, the galvanized coating tends to form an Fe—Zn—Al ternary alloy in spite of the effect of addition of Cu.

If the Al content in the hot-dip galvanizing bath is less than 0.001%, a Zn oxide film is formed on the surface of the bath. The Zn oxide film may adhere to the surface of the galvanized article when removing the galvanized article from the bath, whereby the surface of the galvanized article may become clouded. Therefore, the Al content is preferably 0.003% or more in order to prevent the formation of the Zn oxide film. If the Al content in the bath is too high, the thickness of the alumina layer formed on the surface of the bath increases to a large extent, whereby the alumina layer tends to adhere to the surface of the galvanized article when introducing the galvanized article. Therefore, the Al content is preferably 0.003 to 0.02%.

In recent years, in order to obtain a stable feather-like crystal on the coating surface, to prevent dripping of the galvanizing solution, and to improve adhesion, a Zn—Bi galvanizing bath has been proposed which has a reduced environmental impact.

In this case, the hot-dip galvanizing bath preferably comprises 0.05 to 5.0% of Bi, 0.005 to 0.2% of Cu, and 0.001 to 0.1% of Al.

The Cu content must be 0.005% or more in order to cause the ζ alloy layer to have a uniform columnar structure. The Cu content is ideally 0.01 to 0.08%.

The Zn—Bi—Al—Cu galvanizing bath according to the invention may be a galvanizing bath which does not substantially contain other components. Alternatively, a trace element may be added depending on the required quality, such as adding Sn in an amount of about 0.001 to 0.1%, for example.

If the Bi content is less than 0.05%, the effect of addition is not obtained. Since Bi is more expensive than Zn, the Bi content is preferably 5.0% or less.

When the galvanizing target article is an iron article such as a steel sheet, since the amount of rust on the surface of the iron article is relatively small, the galvanized coating exhibits excellent adhesion to the iron article. The effect of suppressing dripping or retention of the galvanizing solution is remarkably achieved with a Bi content of 0.12 to 2.5%. The Bi content is ideally 0.12 to 0.3%.

When the galvanizing target article is a cast iron article with a relatively large amount of surface rust, it is desirable to form a Bi layer at the bottom of the galvanizing furnace so that the operation of removing dross from the bottom of the furnace is facilitated. Therefore, the Bi content is preferably 0.2 to 2.0%.

The Bi content is preferably 0.05 to 0.3% when it is desired to maintain an excellent surface gloss.

The effect of adding Cu according to the invention is also achieved when using a Zn—Pb galvanizing bath.

In this case, the galvanizing bath comprises 0.05 to 3.0% of Pb, 0.005 to 0.2% of Cu, and 0.001 to 0.1% of Al, with the balance being Zn.

A galvanized iron article which has been galvanized using the galvanizing bath according to the invention has a ζ alloy layer with a uniform thickness and exhibits excellent corrosion resistance and appearance.

In this case, the η zinc layer in the surface portion of the galvanized coating contains 0.005 to 0.2% of Cu.

Since the hot-dip galvanizing bath according to the invention comprises Cu in an amount of 0.005 to 0.2%, and preferably 0.01 to 0.08%, the growth of the ζ alloy layer is suppressed during air cooling until the galvanized article removed from the galvanizing bath is subjected to the next step so that the columnar structure becomes uniform. As a result, the thickness of the alloy layer and the thickness of the galvanized coating become uniform. Moreover, the hot-dip galvanizing bath exhibits an excellent covering power and provides excellent corrosion resistance and appearance.

The addition of Cu also increases the surface gloss of the galvanized coating and improves primary rust prevention performance.

The invention is described below based on experimental data. Note that the invention is not limited thereto.

Each galvanizing bath having the composition shown in the table in FIG. 1 was prepared. A sheet material made of SS400 and having dimensions of 70 mm×150 mm×3.2 mm (thickness) was hot-dip galvanized.

The balance of the composition shown in the table in FIG. 1 is Zn.

The average thickness of the galvanized coating of the test sample was about 60 μm. The sample was subjected to a neutral salt spray test of a plated coating corrosion resistance test in accordance with JIS Z2371, and the amount of wear due to corrosion was measured from the difference between the weight before the test and the weight at each specific elapsed time.

The results are shown in the graph in FIG. 2.

The galvanizing bath shown in FIG. 1 with which the sample No. 1 was formed was prepared by melting only an electrolytic zinc ingot. The sample using only electrolytic zinc exhibits the most excellent corrosion resistance. However, the galvanized coating exhibits inferior mechanical properties to some extent and tends to have an inferior appearance due to an insufficient surface gloss or dripping or retention of the galvanizing solution.

A change in corrosion resistance due to the addition of Al, Cu, and Bi was investigated. The corrosion resistance deteriorated when adding only Bi (sample No. 2). On the other hand, the corrosion resistance was improved by adding Al or Cu in addition to Bi, as is clear from the results of the sample No. 3 (Bi+Al) and the sample No. 4 (Bi+Cu).

The corrosion resistance achieved when adding Cu and Al to electrolytic zinc (sample No. 5) was higher than that when adding only Bi, and the surface gloss of the coating was improved by the addition of Cu.

The corrosion resistance was also improved when adding Cu and Al to electrolytic zinc to which Bi was added (sample No. 6).

In the hot-dip galvanizing bath according to the invention, the content of Cd as an unavoidable impurity is 10 ppm or less so that the environmental impact can be reduced. It is also possible to reduce the content of Pb as an unavoidable impurity to 50 ppm or less.

The effects of components added to the hot-dip galvanizing bath on the galvanized coating structure was investigated.

An electrolytic zinc ingot was melted in an iron furnace, and the bath temperature was adjusted to 450° C.

As unavoidable impurities, the Bi content was 0.004%, the Pb content was 20 ppm or less, and the Cd content was 5 ppm or less. The Al content was less than 0.001%.

Figure 3A:
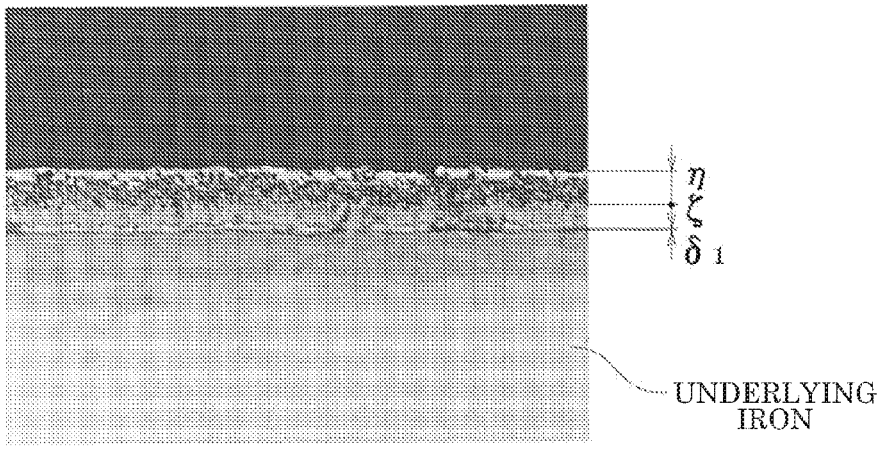
FIGS. 3A to 3C show effects of addition of Al to a hot-dip galvanizing bath.

A steel sheet was immersed in the galvanizing bath for two minutes. The steel sheet was then removed from the galvanizing bath and cooled with water. FIG. 3A shows a micrograph of the cross section of the resulting galvanized coating.

The galvanized coating contained a $\delta_1$ alloy layer formed on the underlying iron, a ζ alloy layer formed on the $\delta_1$ alloy layer, and an η zinc layer formed on the surface side.

Figure 3B:
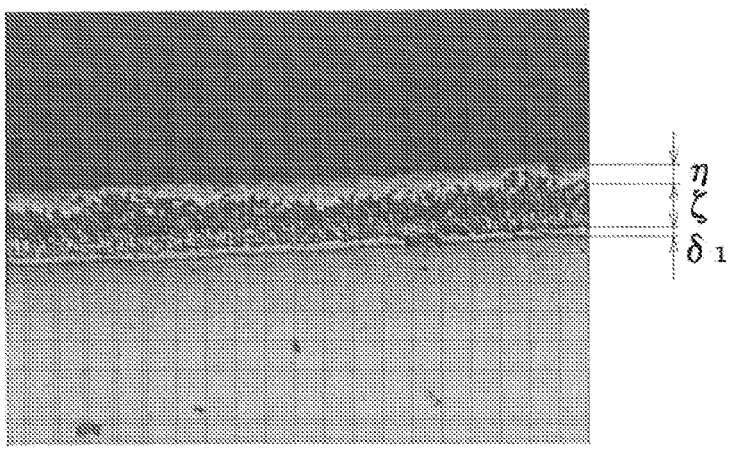

FIG. 3B shows a micrograph of the cross section of a galvanized coating obtained in the same manner as described above except for using a galvanizing bath to which Al was added in an amount of 0.013%.

As shown in FIG. 3B, formation of the ζ alloy layer was promoted so that the thickness of the ζ alloy layer was increased.

Figure 3C:
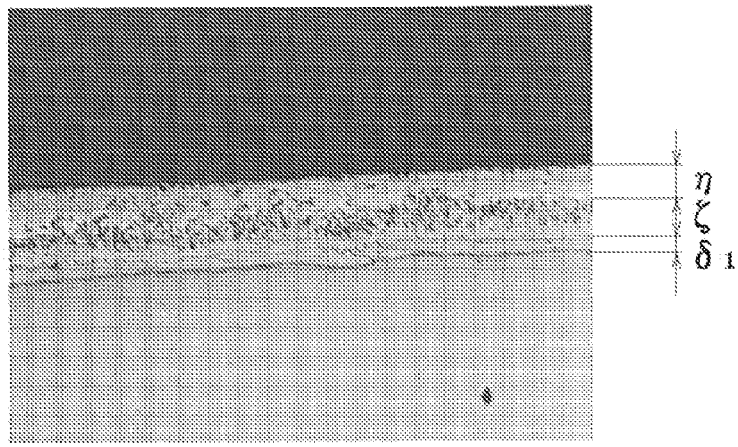

FIG. 3C shows a micrograph of the cross section of a galvanized coating obtained using the above Al-containing galvanizing bath to which Cu was added in an amount of 0.039%.

As shown in FIG. 3C, formation of the ζ alloy layer was suppressed by the addition of Cu so that the thickness of the ζ alloy layer became uniform.

Moreover, the galvanized coating exhibited excellent mechanical properties and an excellent surface gloss, and dripping or retention of the galvanizing solution rarely occurred.

FIG. 4 shows experimental results when adding Bi to a galvanizing bath which did not contain Cu and to which Al was added in an amount of 0.01%.

Figure 4A:
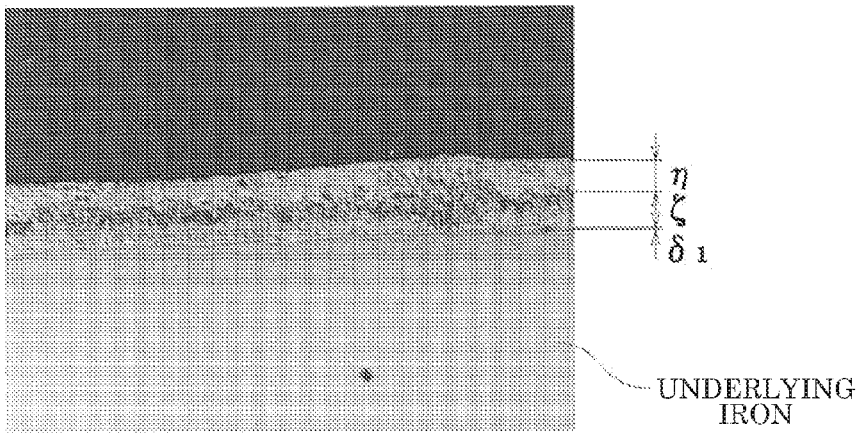
FIGS. 4A to 4C show effects of addition of Cu to a Zn—Bi galvanizing bath.
Figure 4B:
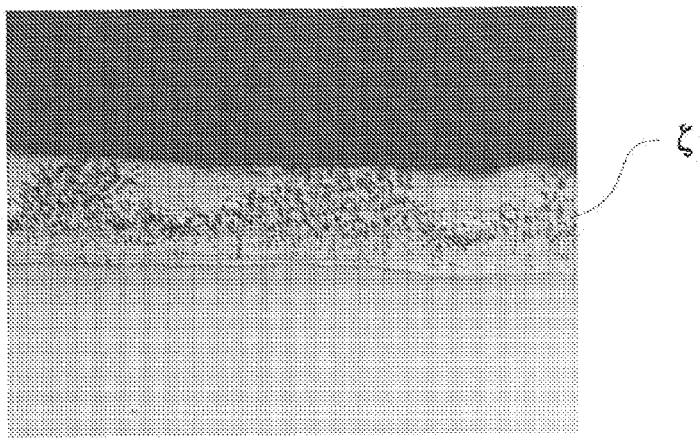

FIG. 4A shows a micrograph of the cross section of a galvanized coating obtained using a galvanizing bath to which Bi was added in an amount of 0.63%, and FIG. 4B shows a micrograph of the cross section of a galvanized coating obtained using a galvanizing bath to which Bi was added in an amount of 1.94%.

The thickness of the ζ alloy layer was increased by the addition of Bi. However, the variation in thickness was very large.

Figure 4C:
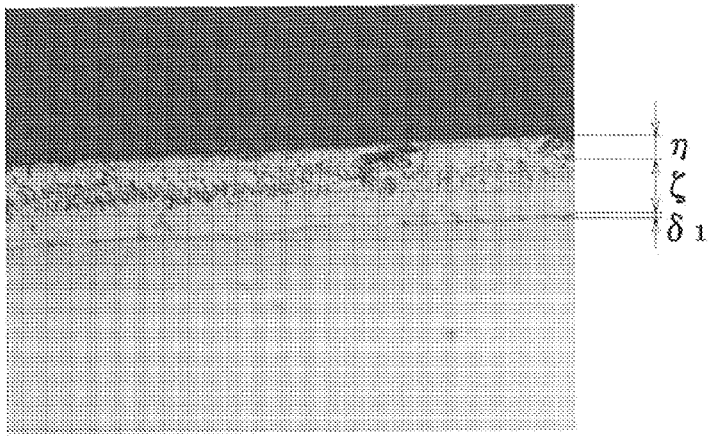

FIG. 4C shows a micrograph of the cross section of a galvanized coating obtained using a galvanizing bath to which Cu was added in an amount of 0.082%.

As shown in FIG. 4C, the thickness of the ζ alloy layer became uniform by the addition of Cu in the same manner as in the example shown in FIG. 3C.

The composition of the bath was again analyzed. The galvanizing bath contained 2.359% of Bi, 0.082% of Cu, and 0.014% of Al, with the balance substantially being Zn.

Figure 5:
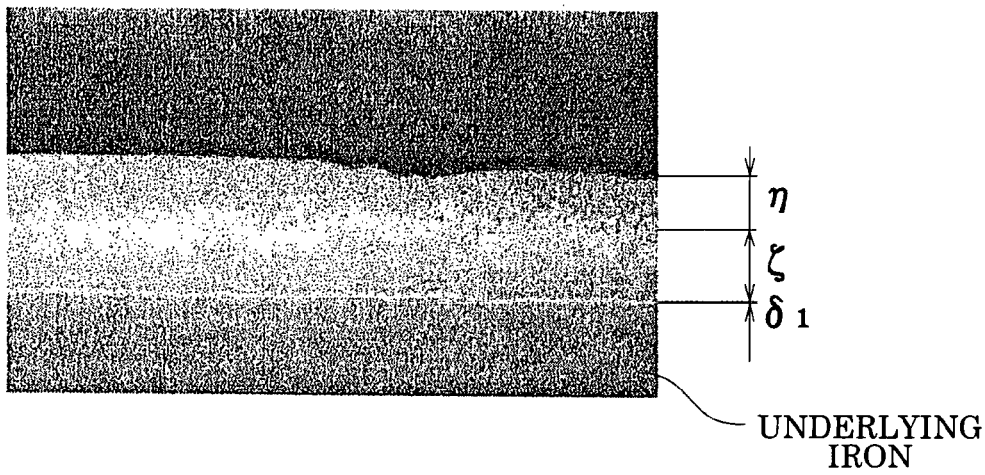
FIG. 5 shows effects of addition of Cu to a Zn—Pb galvanizing bath.
Figure 6:
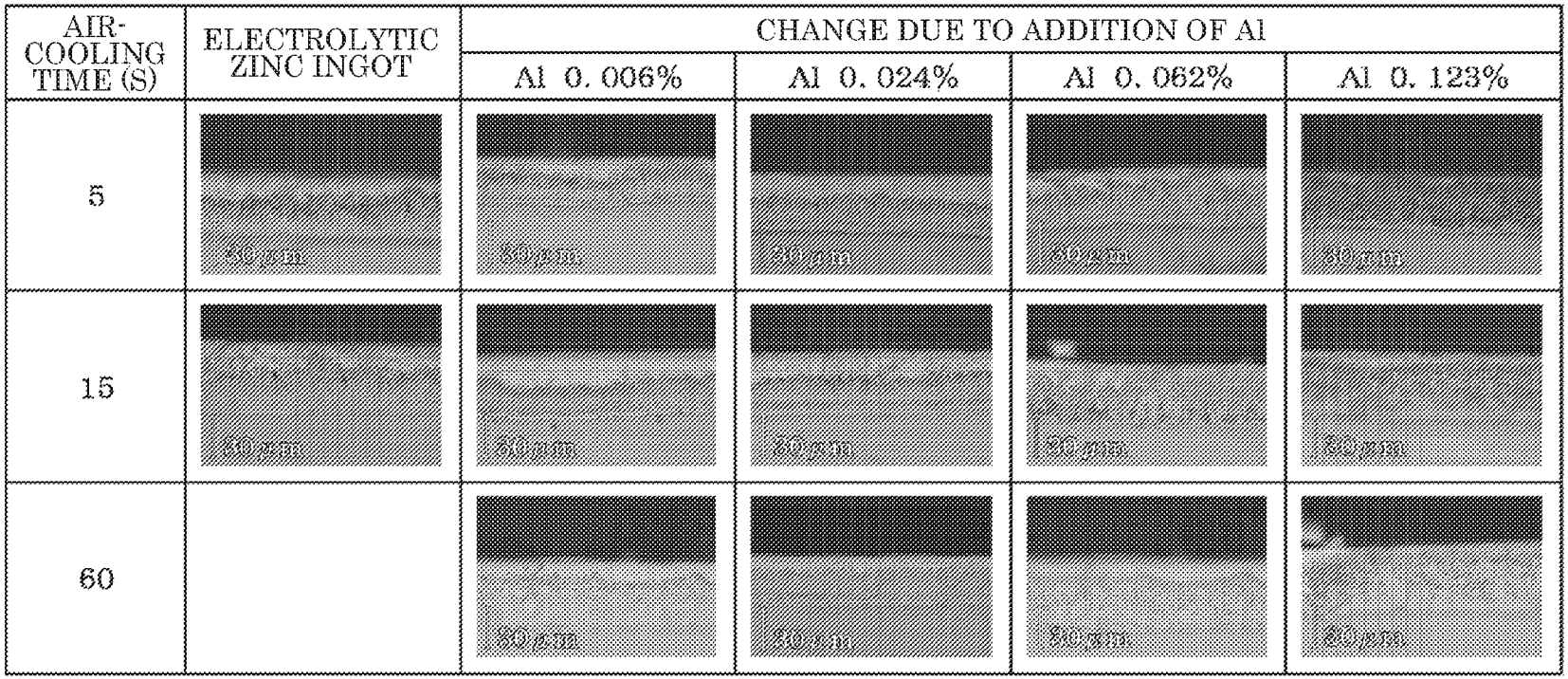
FIG. 6 shows a photograph of the cross section of a galvanized coating structure when Al is added to a galvanizing bath prepared by melting an electrolytic zinc ingot.
Figure 7:
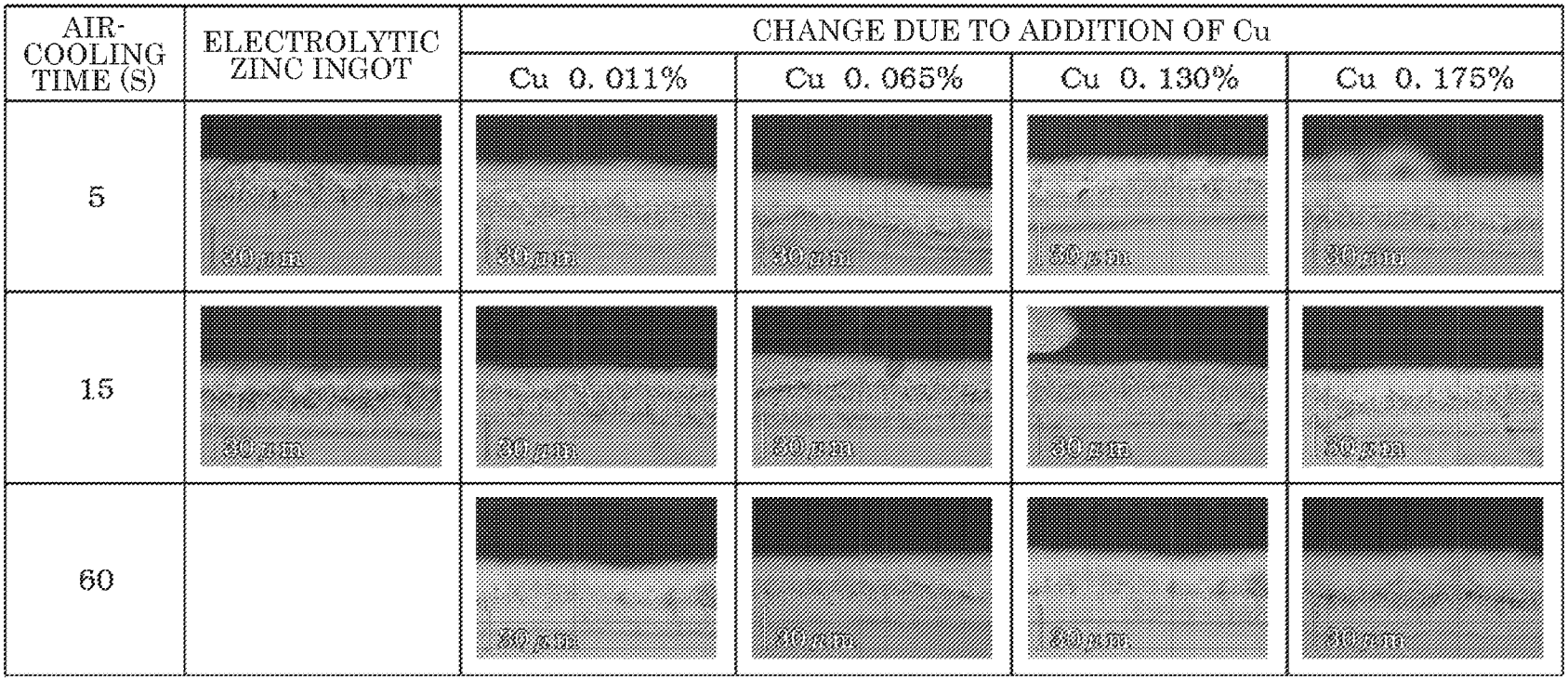
FIG. 7 shows a photograph of the cross section of a galvanized coating structure when Cu is added to a galvanizing bath prepared by melting an electrolytic zinc ingot.
Figure 8:
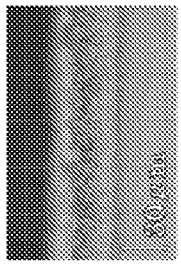
FIG. 8 shows a photograph of the cross section of a galvanized coating structure when Al and Cu are added to a galvanizing bath prepared by melting an electrolytic zinc ingot.
Figure 8:
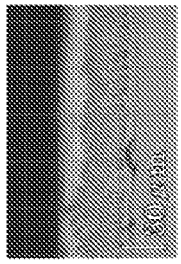
Figure 8:
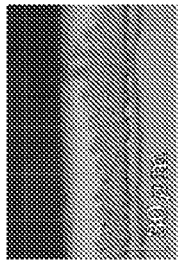
Figure 8:
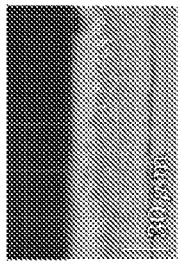
Figure 8:
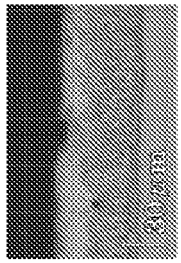
Figure 9:
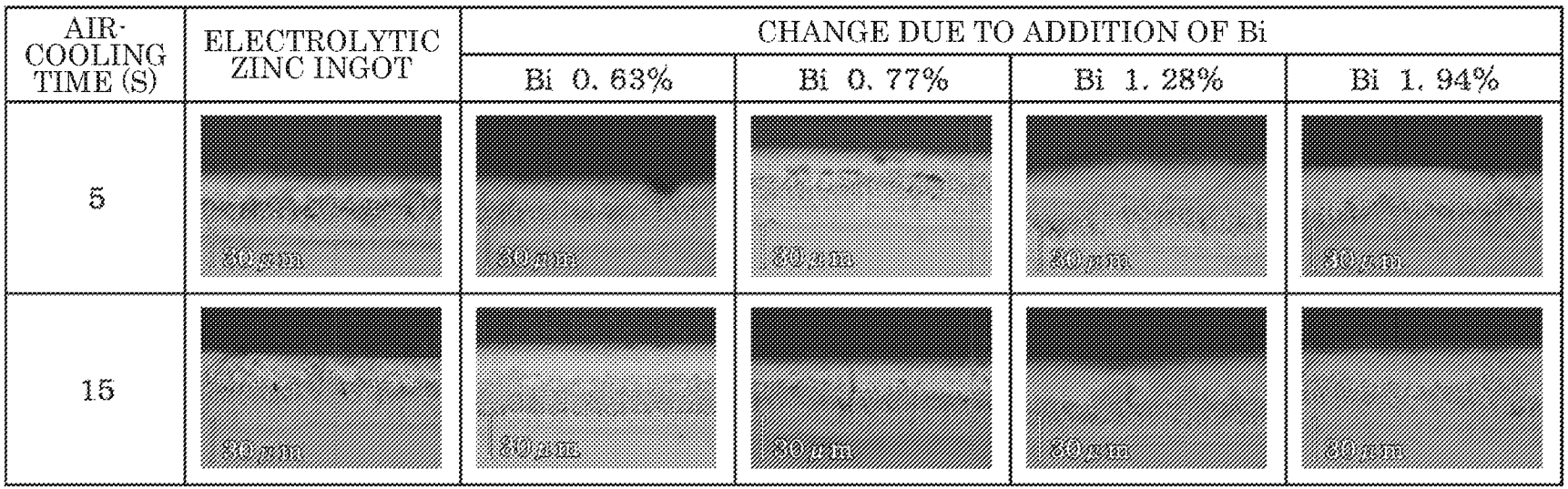
FIG. 9 shows a micrograph of the cross section of a galvanized coating structure when Bi is added to a galvanizing bath prepared by melting an electrolytic zinc ingot.

The above effect of addition of Cu was also observed when using a Zn—Pb galvanizing bath. FIG. 5 shows a micrograph of the cross section of a galvanized coating obtained using the Zn—Pb galvanizing bath.

As shown in FIG. 5, the ζ alloy layer was uniformly formed. The galvanizing bath contained 0.88 to 0.91% of Pb, 0.036% of Cu, and 0.017% of Al, with the balance substantially being Zn.

In order to investigate the cause of the change in the galvanized coating structure due to the addition of Al, Cu, and Bi in detail, a change in the galvanized coating structure with respect to the element added was observed using a microscope with the passage of time in the air (air-cooling time) (unit: second) after removing the galvanized article from the hot-dip galvanizing bath.

FIGS. 6 to 9 show the photographs obtained. In FIGS. 6 to 9, the term "electrolytic zinc ingot" refers to a state in which an electrolytic zinc ingot was melted and no element was added.

Figure 10B:
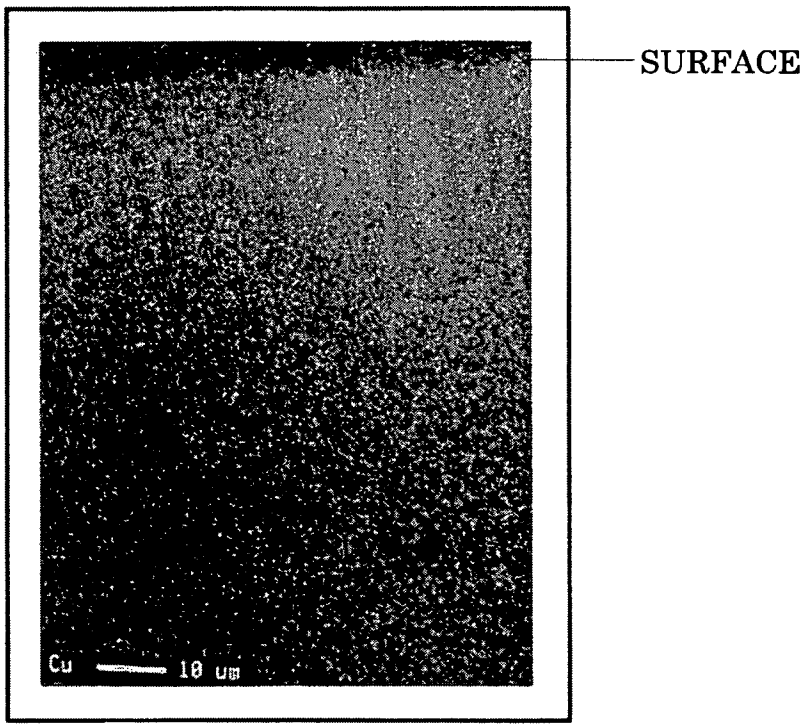
FIGS. 10A and 10B show analysis results of Al and Cu when subjecting the cross section of a galvanized coating to surface analysis.
Figure 10A:
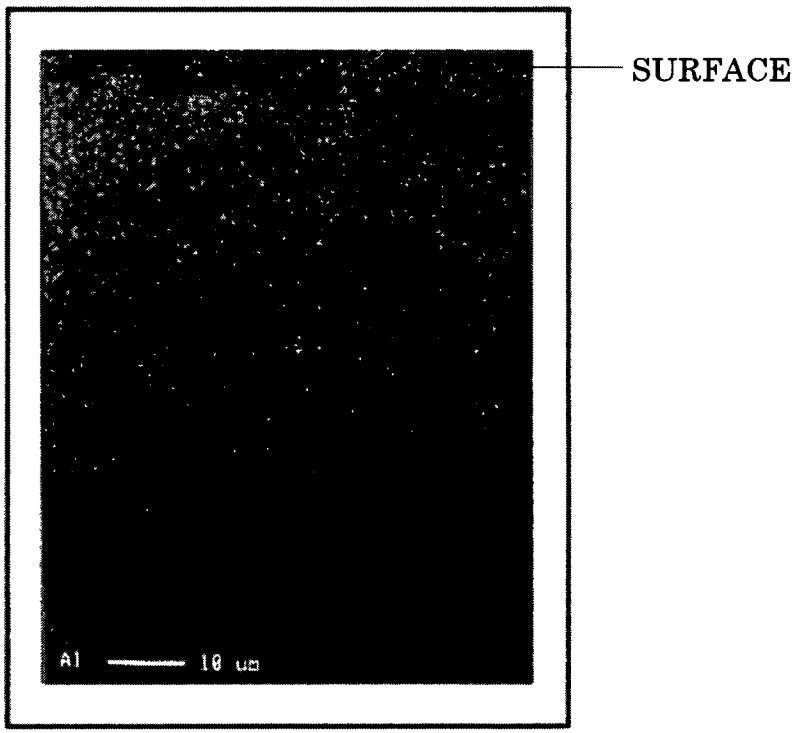

FIGS. 11 to 19 show measurement data of the total thickness of the galvanized coating (i.e., alloy layers ($\zeta+\delta_1$) and η layer) based on the micrographs. FIGS. 10A and 10B shows surface analysis results of the cross sections of the galvanized coating obtained when adding Al to the galvanizing bath and the galvanized coating obtained when adding Cu to the galvanizing bath.

Al tends to precipitate near the surface of the coating, and Cu is relatively uniformly dispersed in the coating.

Figure 11:
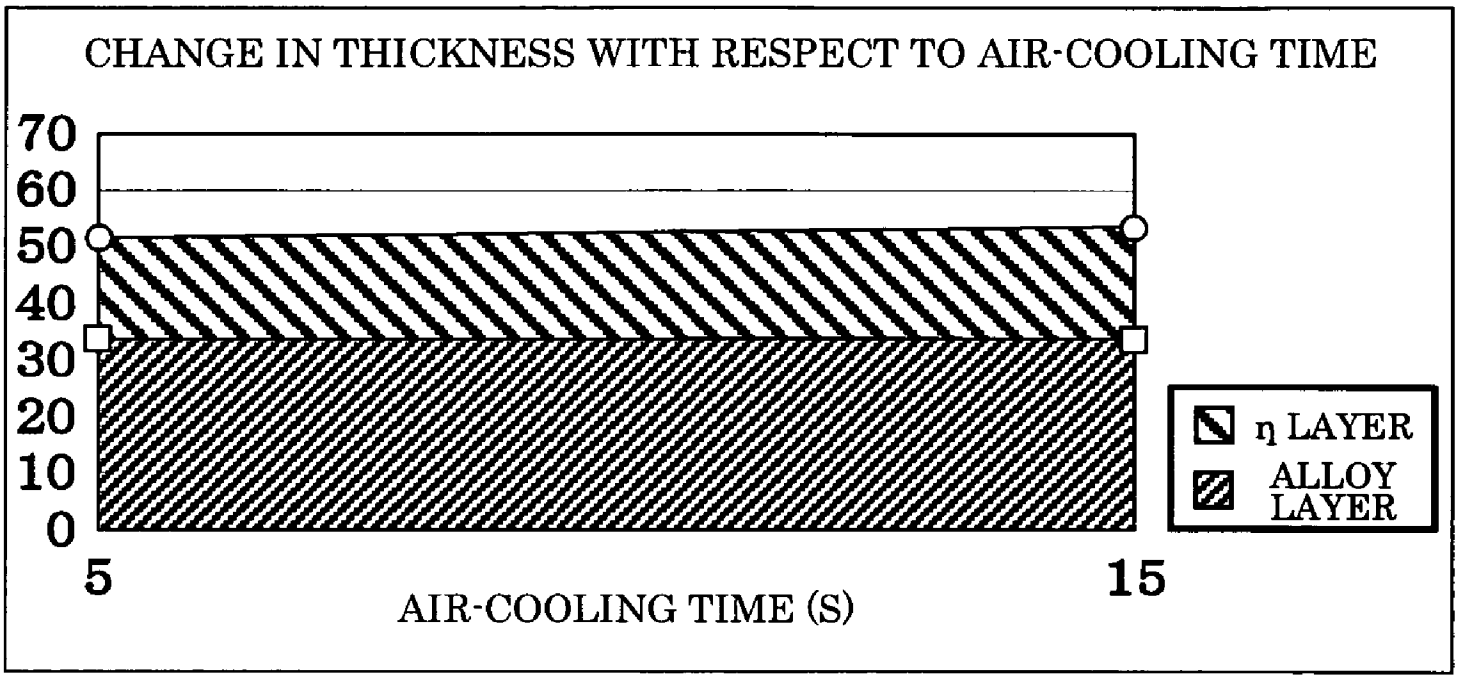
FIG. 11 shows a change in structure of a galvanized coating prepared using only an electrolytic zinc ingot during air cooling.

A change in the galvanized coating structure was investigated. As shown in FIG. 11, when using a galvanizing bath prepared by melting only an electrolytic zinc ingot, the thickness of the alloy layer changed to only a small extent between the air-cooling time of 5 seconds and the air-cooling time of 15 seconds. FIGS. 12A to 12D and FIGS. 13A to 13C show changes in the galvanized coating structure when adding Al to the galvanizing bath. As a result of comparison at an air-cooling time of 5 seconds, the thickness of the alloy layer was about 25 μm when the Al content was 0.006% (see FIG. 12A), and the thickness of the alloy layer was increased as the Al content was increased, as shown in FIGS. 12B to 12D and FIGS. 13A to 13C. The thickness of the alloy layer exceeded 30 nm when the Al content was 0.062% (see FIG. 12C). The same tendency was observed at an air-cooling time of 30 or 60 seconds (see FIGS. 13B and 13C).

Figure 12A:
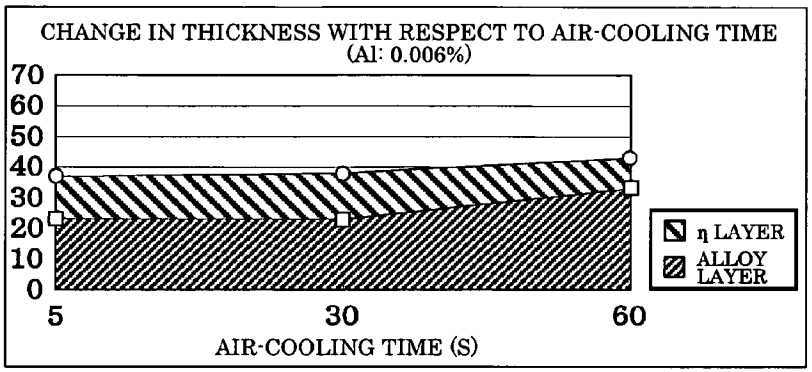
FIGS. 12A to 12D show changes in structure of a galvanized coating during air cooling when adding Al.
Figure 12B:
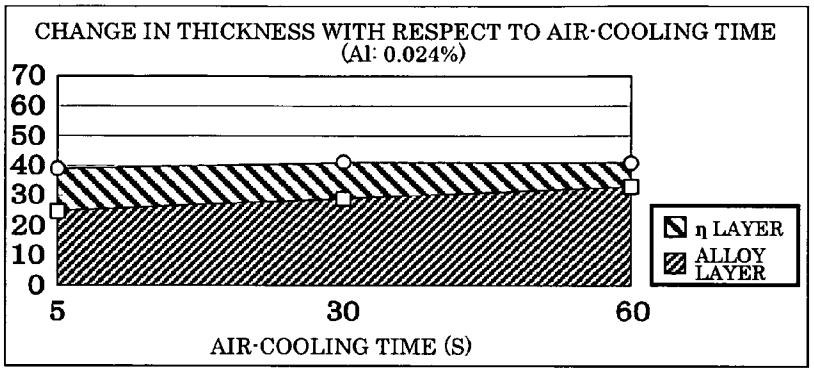
Figure 12C:
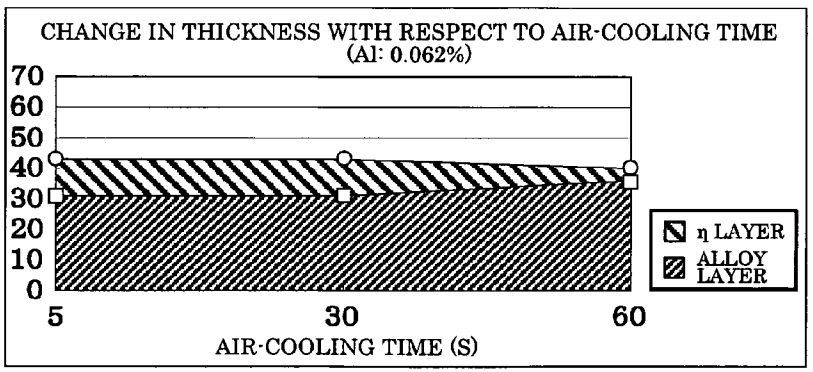
Figure 12D:
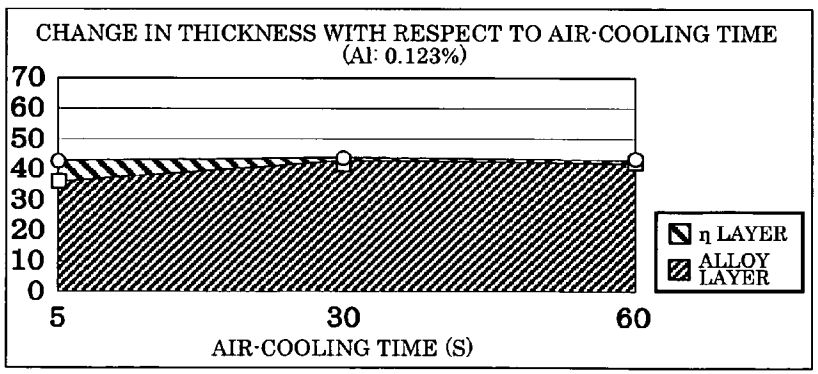
Figure 13A:
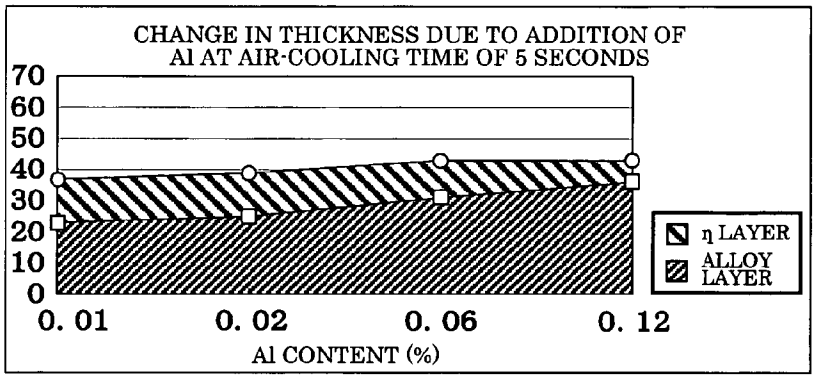
FIGS. 13A to 13C show the relationship between the amount of Al added and a change in structure of a galvanized coating during air cooling.
Figure 13B:
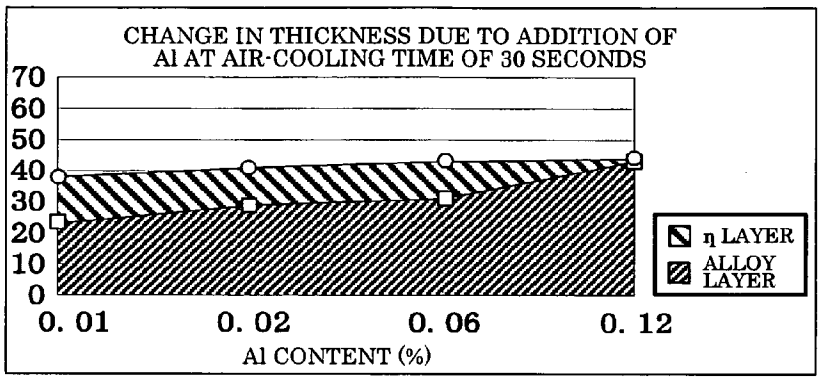
Figure 13C:
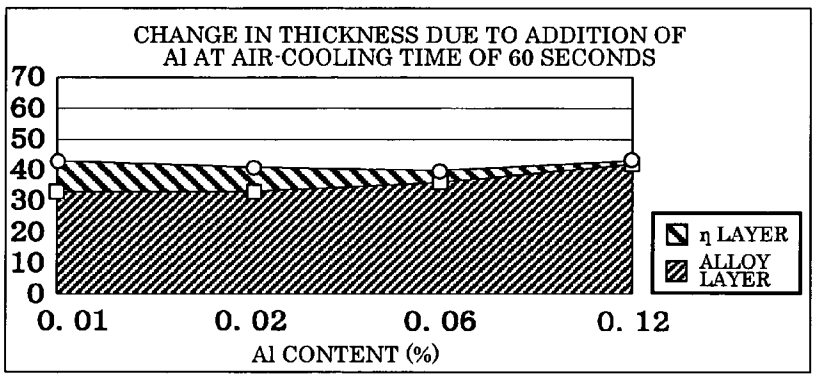

As shown in FIG. 12D, the thickness of the alloy layer changed to a large extent when the Al content was 0.123%. This is considered to be because the alloy layer formed a Zn—Fe—Al ternary alloy layer, as shown in the micrograph.

The thickness of the alloy layer was increased and became nonuniform by the addition of Al.

As shown in FIG. 7, FIGS. 14A to 14D, and FIGS. 15A and 15B, the growth of the alloy layer during air cooling was suppressed by the addition of Cu so that the alloy layer remained uniform.

For example, when the Cu content was 0.0065% (see FIG. 14B), the thickness of the η layer was changed to only a small extent during air cooling.

Figure 14A:
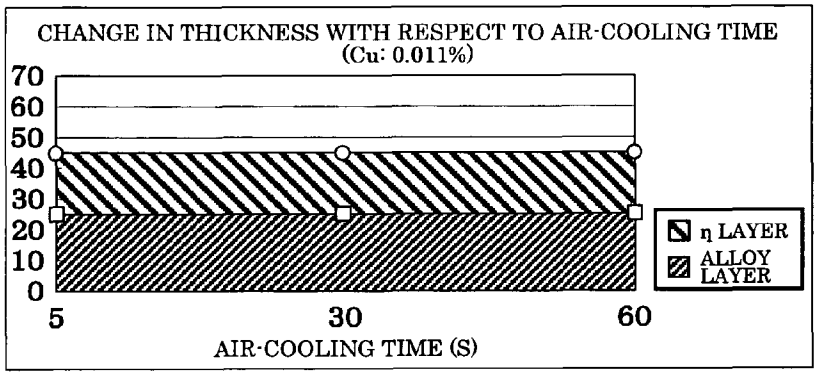
FIGS. 14A to 14D show changes in structure of a galvanized coating during air cooling when adding Cu.
Figure 14B:
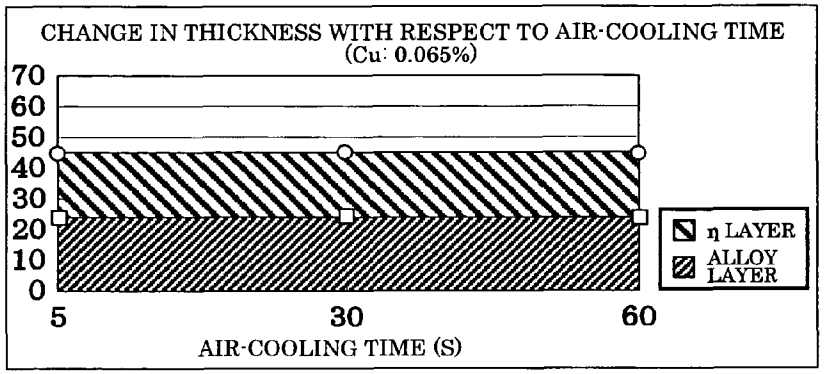
Figure 14C:
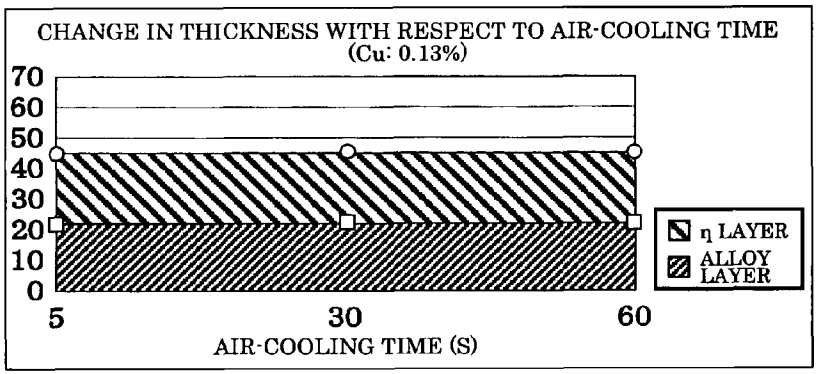
Figure 14D:
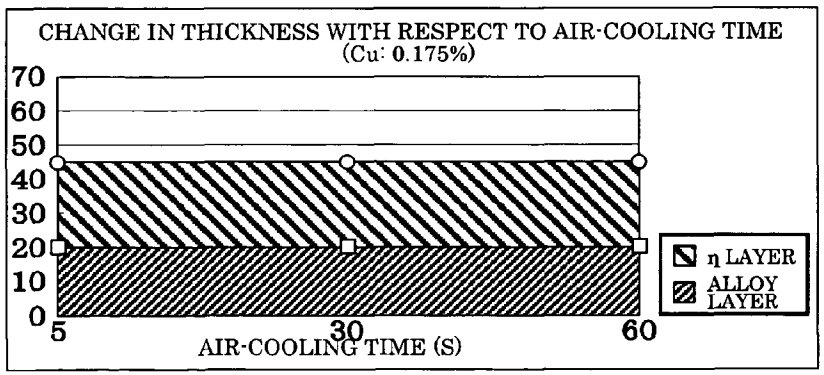
Figure 15A:
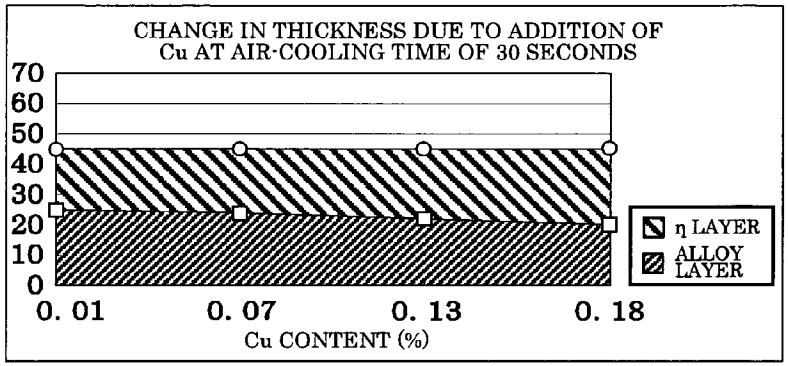
FIGS. 15A and 15B show the relationship between the amount of Cu added and a change in structure of a galvanized coating during air cooling.
Figure 15B:
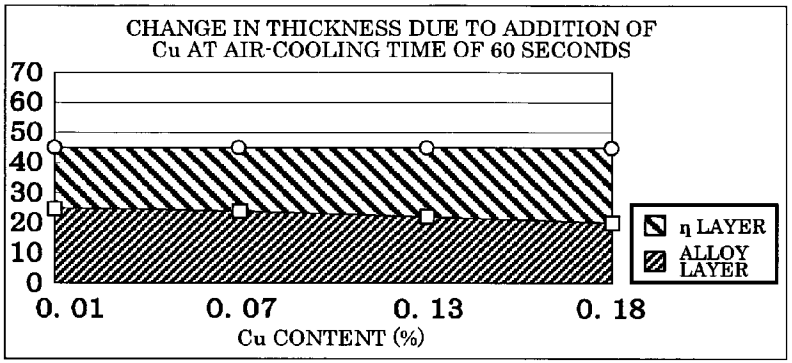
Figure 16A:
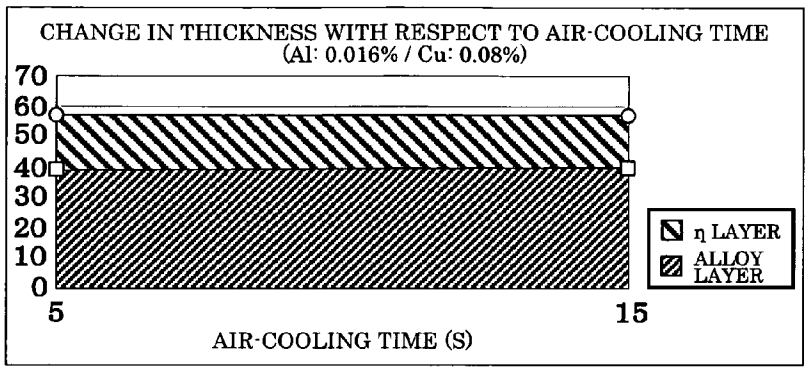
FIGS. 16A to 16D show changes in structure of a galvanized coating during air cooling when adding Al and Cu.
Figure 16B:
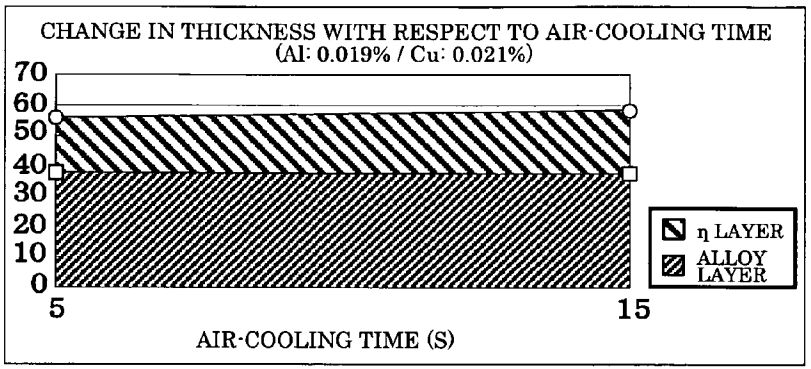
Figure 16C:
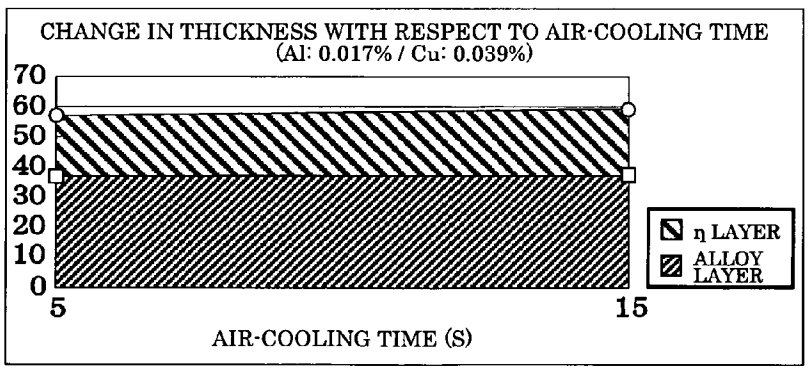
Figure 16D:
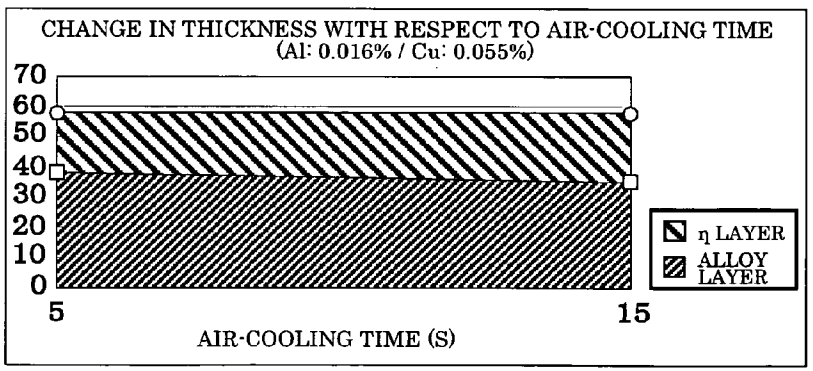
Figure 17A:
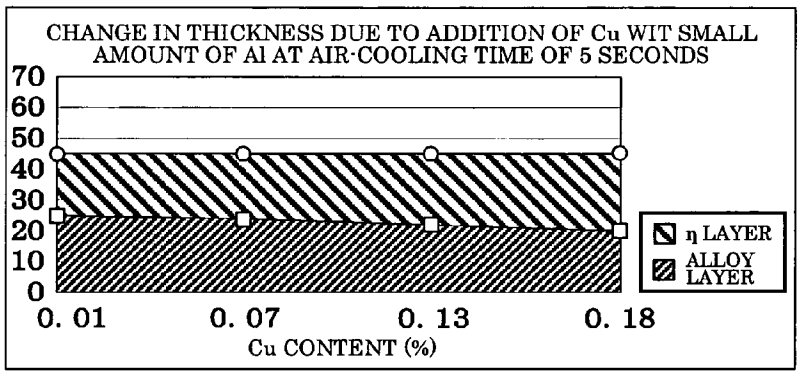
FIGS. 17A and 17B show the relationship between the amounts of Al and Cu added and a change in structure of a galvanized coating during air cooling.
Figure 17B:
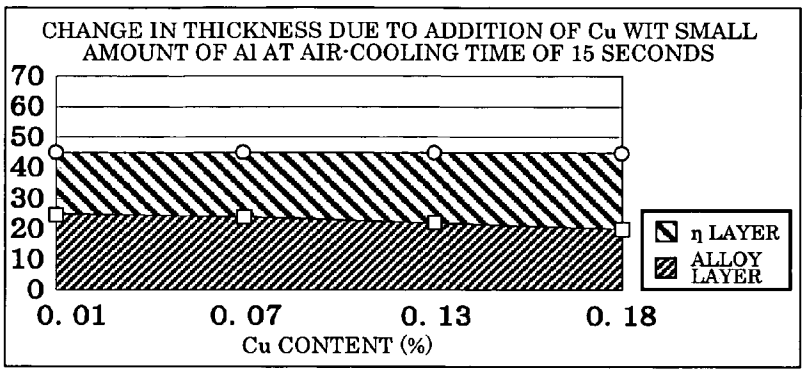
Figure 18A:
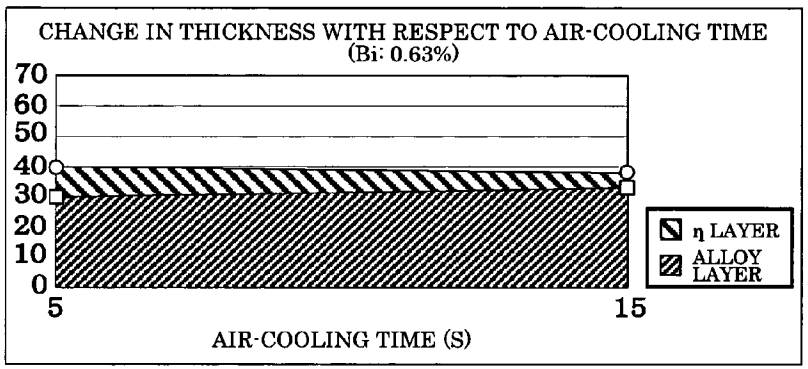
FIGS. 18A to 18D show changes in structure of a galvanized coating during air cooling when adding Bi.
Figure 18B:
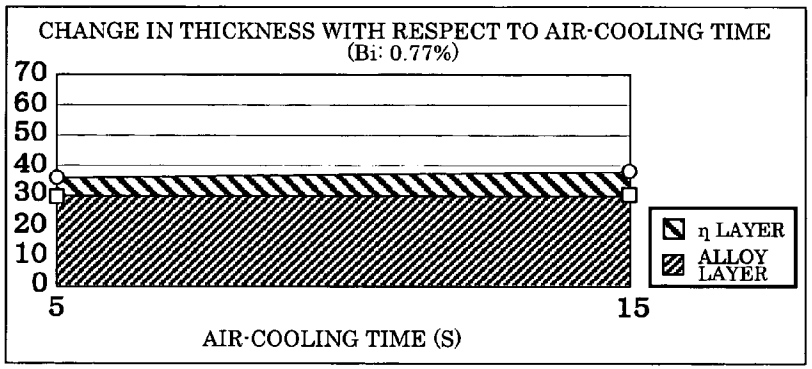
Figure 18C:
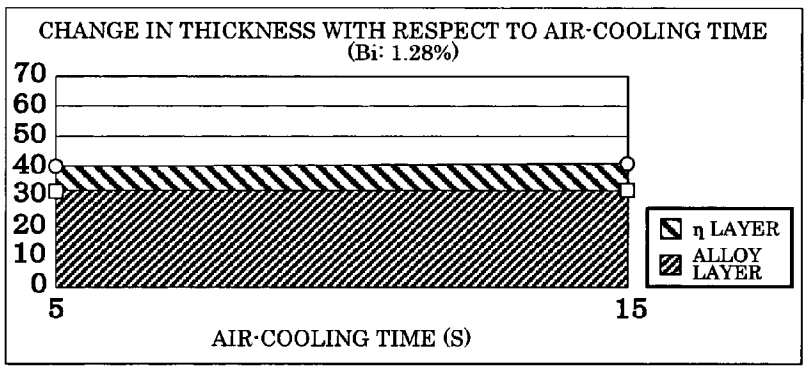
Figure 18D:
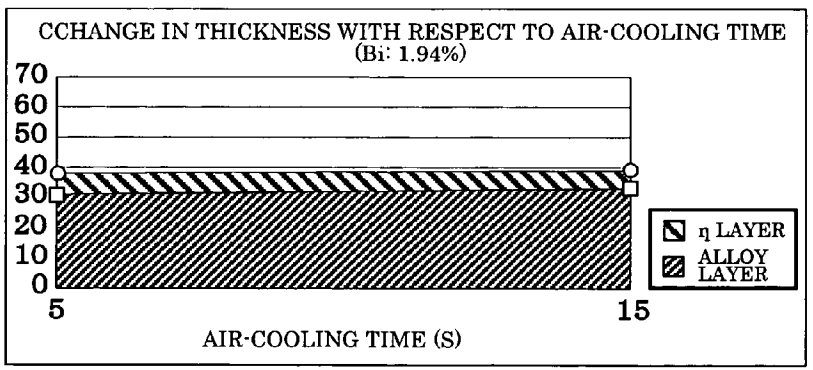
Figure 19A:
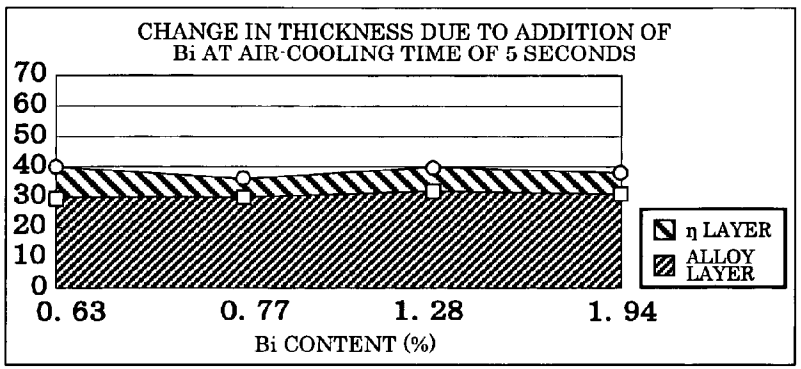
FIGS. 19A and 19B show the relationship between the amount of Bi added and a change in structure of a galvanized coating during air cooling.
Figure 19B:
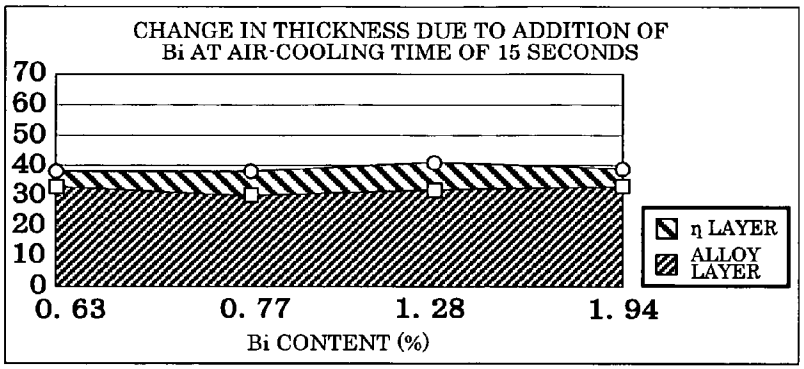

As the effect of Cu during immersion in the galvanizing bath, while the thickness of the alloy layer was 25 to 28 μm when the Cu content was 0.011% (see FIG. 14A), the thickness of the alloy layer was reduced to about 20 μm when the Cu content was 0.175% (see FIG. 14D).

Regarding the effects of addition of Al and Cu, as shown in FIG. 8, FIGS. 16A to 16D, and FIGS. 17A and 17B, the thickness of the alloy layer was increased during immersion in the galvanizing bath by the addition of Al, and the growth of the alloy layer was suppressed during air cooling by the addition of Cu so that the η layer was uniform and the coating had a surface gloss.

As is clear from the data shown in FIG. 9, FIGS. 18A to 18D, and FIGS. 19A and 19B, the alloy layer was grown during air cooling by the addition of Bi so that the alloy layer became nonuniform.

The above investigation results confirmed that the ζ alloy layer is made uniform by adding Cu to the hot-dip galvanizing bath, and the uniformity is improved by suppressing the growth of the ζ alloy layer during air cooling (during transfer in the air) after removing the galvanized article from the galvanizing bath.

Since the galvanizing bath according to the invention produces a galvanized coating which has high uniformity and a gloss and improves primary rust prevention performance and corrosion resistance, the galvanizing bath according to the invention can be utilized as an excellent hot-dip galvanizing method for iron articles.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

What is claimed is:

1. A galvanized iron article formed by hot-dipping an iron article in a galvanizing bath consisting of 0.005 to 0.175 mass % of Cu and 0.001 to 0.1 mass % of Al, with the balance being Zn and unavoidable impurities, to provide a galvanized layer directly on the iron article;

wherein an η layer having a Cu content of 0.005 to 0.175 mass % is formed at an outermost surface of the galvanized layer.

2. A galvanized iron article formed by hot-dipping an iron article in a galvanizing bath consisting of 0.005 to 0.175 mass % of Cu, 0.001 to 0.1 mass % of Al, and 0.05 to 5.0 mass % of Bi, with the balance being Zn and unavoidable impurities, to provide a galvanized layer directly on the iron article;

wherein an η layer having a Cu content of 0.005 to 0.175 mass % is formed at an outermost surface of the galvanized layer.

3. A galvanized iron article formed by hot-dipping an iron article in a galvanizing bath consisting of 0.005 to 0.175 mass % of Cu, 0.001 to 0.1 mass % of Al, 0.05 to 5.0 mass % of Bi, and 0.001 to 0.1 mass % of Sn, with the balance being Zn and unavoidable impurities, to provide a galvanized layer directly on the iron article;

wherein an η layer having a Cu content of 0.005 to 0.175 mass % is formed at an outermost surface of the galvanized layer.

4. A galvanized iron article formed by hot-dipping an iron article in a galvanizing bath consisting of 0.005 to 0.175 mass % of Cu, 0.001 to 0.1 mass % of Al, and 0.05 to 3.0 mass % of Pb, with the balance being Zn and unavoidable impurities, to provide a galvanized layer on the iron article;

wherein an η layer having a Cu content of 0.005 to 0.175 mass % is formed at an outermost surface of the galvanized layer.

5. A galvanized iron article formed by hot-dipping an iron article in a galvanizing bath consisting of 0.005 to 0.175 mass % of Cu, 0.001 to 0.1 mass % of Al, 0.05 to 3.0 mass % of Pb, and 0.001 to 0.1 mass % of Sn, with the balance being Zn and unavoidable impurities, to provide a galvanizing layer directly on the iron article;

wherein an η layer having a Cu content of 0.005 to 0.175 mass % is formed at an outermost surface of the galvanized layer.

* * * * *